US008450656B2

(12) United States Patent
Doyal et al.

(10) Patent No.: US 8,450,656 B2
(45) Date of Patent: May 28, 2013

(54) COOKING APPARATUS WITH PROTECTIVE SHIELD

(75) Inventors: Timothy P. Doyal, Goodlettsville, TN (US); James L. Ayres, Springfield, TN (US); Brian A. Roberts, White House, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 1248 days.

(21) Appl. No.: 12/258,619

(22) Filed: Oct. 27, 2008

(65) Prior Publication Data

US 2010/0101754 A1 Apr. 29, 2010

(51) Int. Cl.
*H05B 3/68* (2006.01)
*F24B 5/04* (2006.01)

(52) U.S. Cl.
USPC ..... 219/443.1; 219/452.11; 126/15 R

(58) Field of Classification Search
USPC .. 219/390–396, 443.1, 450.1–452.13; 126/15 R, 19 R, 21 R, 21 A, 22
See application file for complete search history.

(56) References Cited

U.S. PATENT DOCUMENTS

| | | | | |
|---|---|---|---|---|
| 2,480,044 | A * | 8/1949 | Reeves | 126/21 R |
| 2,743,719 | A * | 5/1956 | Reeves | 126/21 R |
| 2,823,664 | A | 2/1958 | Evans et al. | |
| 3,057,341 | A | 10/1962 | Perl | |
| 5,546,928 | A | 8/1996 | Lewis et al. | |
| 6,761,159 | B1 * | 7/2004 | Barnes et al. | 126/21 R |

FOREIGN PATENT DOCUMENTS

EP 0482602 4/1992

OTHER PUBLICATIONS

International Search Report for PCT/US2009/061282, dated Apr. 29, 2010, 3 pages.

* cited by examiner

*Primary Examiner* — Sang Paik
(74) *Attorney, Agent, or Firm* — Pearne & Gordon LLP

(57) ABSTRACT

A cooking apparatus is provided that comprises a housing structure, an internal heating source, an exit, a control panel, and a protective shield. The internal heating source is located within the housing structure. The exit is located at an exterior portion of the housing structure where the exit is configured to transport heat emissions from the internal heating source. The control panel is located above the exit. The protective shield is coupled to the housing structure where the protective shield is configured to deflect the heat emissions in a direction away from the control panel.

13 Claims, 2 Drawing Sheets

COOKING APPARATUS WITH PROTECTIVE SHIELD

FIELD OF THE INVENTION

The present invention relates generally to a shield for use with cooking apparatuses, and more particularly, to shields that deflect heat away from a control panel.

BACKGROUND OF THE INVENTION

Typically, a cooking apparatus such as a range includes channels that exhaust emissions from a heating element. Conventionally, a control panel and/or a bezel are located at an exit that exhausts emissions of a high temperature. The emissions rise upwards from within the cooking apparatus and can raise the temperature of the bezel and the control panel to the point that discoloration and melting of the controls can occur. The emissions can also cause excessive heat issues at other areas surrounding the exit.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a cooking apparatus is provided that comprises a housing structure, an internal heating source, an exit, a control panel, and a protective shield. The internal heating source is located within the housing structure. The exit is located at an exterior portion of the housing structure where the exit is configured to transport heat emissions from the internal heating source. The control panel is located above the exit. The protective shield is coupled to the housing structure where the protective shield is configured to deflect the heat emissions in a direction away from the control panel.

In accordance with another aspect of the present invention, a cooking apparatus is provided that comprises at least one heating element, a housing structure, an internal heating source, an exit, a channel, a control panel, a bezel, and a protective shield. The at least one heating element is located on a top surface of the cooking apparatus. The housing structure is located below the at least one heating element. The internal heating source is located within the housing structure. An exit is located at an exterior portion of the housing structure where the exit is configured to transport heat emissions from the internal heating source and where the exit includes an upper surface. The channel is located within the housing structure and the channel is configured to transport the heat emissions to the exit. The control panel is supported by the housing structure above the exit. The bezel is located above the exit and is supported by the housing structure and is further located below the control panel. The protective shield is connected to one of the upper surface of the exit or a bottom edge of the bezel. The protective shield has a length that extends outwards beyond the control panel. A first portion of the protective shield includes a connecting portion that is configured to connect the protective shield to one of the upper surface of the exit or the bottom edge of the bezel. The first portion of the protective shield is generally horizontal when viewed from the side. A second portion of the protective shield has a curvature and extends downwardly from the first portion when viewed from the side. The protective shield is configured to deflect emissions in a direction away from the bezel and the control panel.

BRIEF DESCRIPTION OF THE SEVERAL VIEWS OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
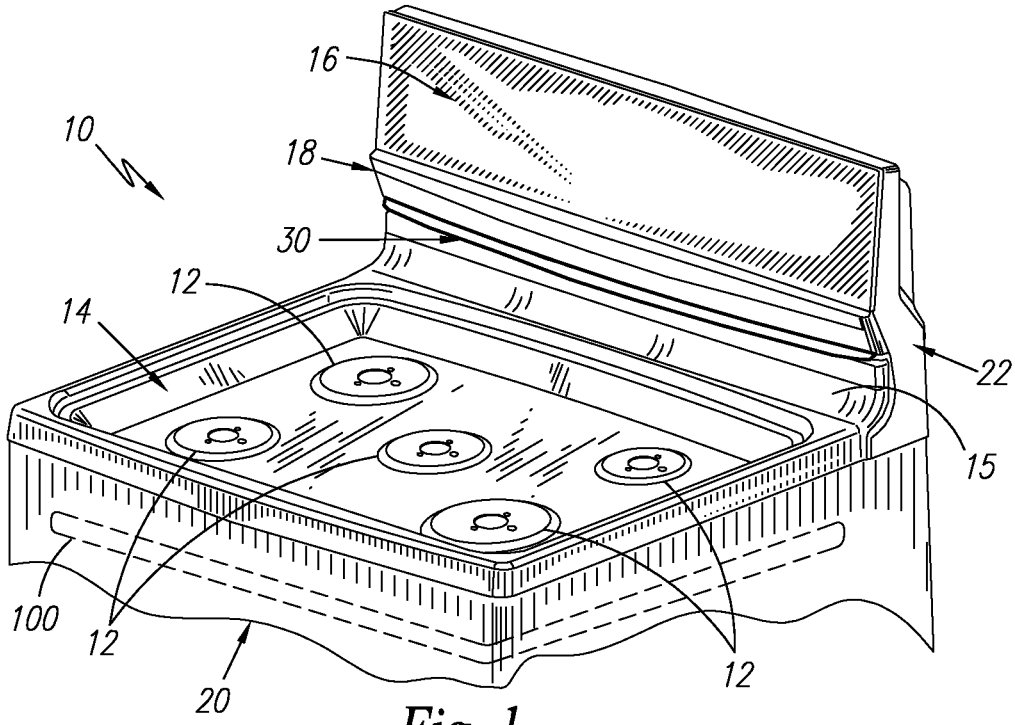
FIG. 1 is a perspective view of an example cooking apparatus that includes an example shield.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

In FIG. 1, an example cooking apparatus 10 is shown. In this example, the cooking apparatus 10 is a range though in other examples, other cooking apparatuses can be used. The cooking apparatus 10 includes at least one heating element 12 on a top surface 14 of the cooking apparatus 10. The cooking apparatus 10 also can include a control panel 16 and in further examples, the cooking apparatus 10 can include a bezel 18. The control panel 16 can be a touch-pad or other touch-sensitive surface. In other examples, the control panel 16 can include various controls, such as buttons, knobs or other devices that can be operated or actuated in response to an operator touching the control panel 16. The control panel 16 is oriented in this example on a generally vertical surface. It is appreciated that other orientations and configurations can be used for the control panel 16. Moreover, the control panel 16 can be placed on other oriented surfaces and on other shaped surfaces. The bezel 18 is located below the control panel 16. The bezel 18 can be a trim piece, a panel casing, or other decorative piece and can be formed of a piece of material that is separate from the other structure in the cooking apparatus 10. The bezel 18 can be provided for aesthetic purposes. The bezel 18 can have various shapes and surface textures.

The cooking apparatus 10 can further include a housing structure 20 that can support the top surface 14 of the cooking apparatus 10. The housing structure 20 can include structure such as energy sources for the heating elements 12 and an internal heating source 100 within the housing structure 20 configured for heating an internal compartment. The internal heating source 100 can be present at one or more different locations. Many different types of heating sources can be used. Although the internal heating source 100 is shown in FIG. 1 at the top of the cooking cavity, it is appreciated that many different configurations for the housing structure 20 can be used. The housing structure 20 can further include an upper housing portion 22 that can be connected along a portion of a perimeter of the top surface 14 of the cooking apparatus 10. In this example, the upper housing portion 22 is located along a rear edge of the top surface 14 of the cooking apparatus 10. The upper housing portion 22 can extend upwards and can be coupled to the control panel 16 and to the bezel 18. The upper housing portion 22 can support the control panel 16 and the bezel 18 in various locations relative to the top surface 14 of the cooking apparatus 10. It is also appreciated that the housing structure 20 can be comprised of one integral piece that includes the upper housing portion 22 or can be comprised of a plurality of components. The housing structure 20 can be comprised of various materials including similar metals or other materials as the top surface 14 of the cooking apparatus 10.

The cooking apparatus 10 further includes a protective shield 30. The protective shield 30 can be coupled to the housing structure 20 at different portions of the housing structure 20. In the shown example, the protective shield 30 can be located below the bezel 18. The protective shield 30 can be configured to deflect heat and other emissions in a direction away from the control panel. In one example, the protective shield 30 can prevent discoloration and damage to the control panel by deflecting the heat in a direction away from the control panel. The protective shield can be comprised of various materials such as steel, aluminum, or other extruded materials. The protective shield 30 can be configured to deflect heat in a number of desired directions. The protective shield 30 can cool and reduce the temperature of the control panel 16 and the bezel 18 and can reduce or prevent the amount of heat that the control panel 16 and the bezel 18 are subjected to.

Figure 2:
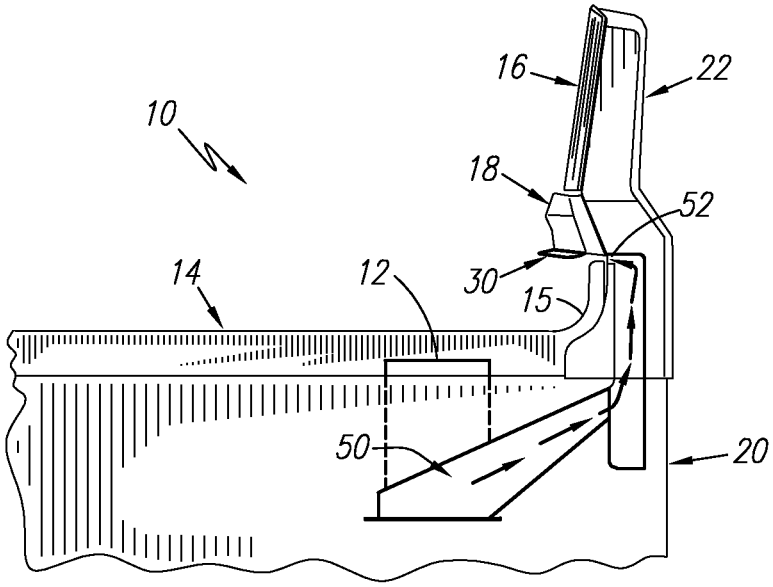
FIG. 2 is a side view of the example cooking apparatus and the example shield of FIG. 1.

In FIG. 2, a sectional side view of the cooking apparatus 10 is shown. The top surface 14 of the cooking apparatus 10 and the control panel 16 can be seen along with the protective shield 30. The side view shows a sectional view of a channel 50. The channel 50 is located within the housing structure 20. The channel 50 can be an oven vent such as a flue box and can begin at a point near the internal heating source 100 of an interior cooking chamber, such as the oven chamber. The channel 50 can be configured to transport the heat emissions from the internal heating source 100. The internal heating source 100 expels heat emissions into the channel 50 and the channel 50 facilitates movement of the heat emissions to an exit 52. The exit 52 is located below the bezel 18 and the control panel 16. In this example, the top surface 14 of the cooking apparatus can include a vertical section 15 that curves upwards and is located adjacent to the upper housing portion 22. In other examples, the vertical section 15 is not included. In further examples, the channel 50 need not be included as the cooking apparatus can have various types of passageways to transport the heat emissions to an exit 52.

The channel 50 can have many different shapes to create different air paths for the heat emissions. In the example shown, the channel 50 can begin at a location below one of the heating elements 12. Of course, the channel 50 can begin at other locations and this is just one example of where the channel is located. The channel 50 can transport the heat emissions towards the rear of the housing structure 20 of the cooking apparatus 10. In other examples, the channel 50 can transport the heat emissions in an angled orientation to transport the emissions upwardly and rearwardly. The channel 50 can then transport the heat emissions upwardly through the upper housing portion 22. Finally, the channel 50 can transport the heat emissions in a forwards direction through the exit 52. Of course, many different shapes involving different lengths and orientations for each segment of the channel 50 can also be used. In other examples, the channel 50 can be located in a higher location of the internal oven and can also be located at different positions relative to the front and rear of the cooking apparatus 10.

Figure 3:
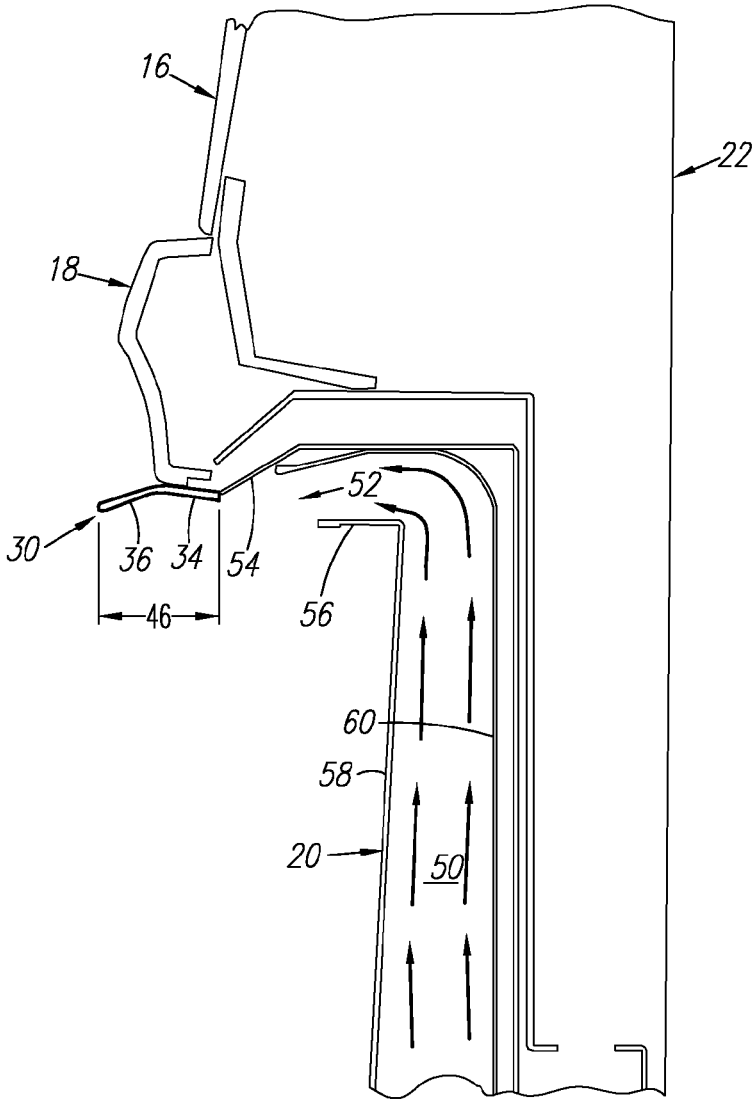
FIG. 3 is a sectional view of FIG. 2 showing the example shield, an exit, and a channel that expels emissions from an internal heating source of the example cooking apparatus.

The protective shield 30 can be located below the bezel 18 and can be configured to deflect the emissions from the exit 52 in a direction that is away from the bezel and the control panel. In one example, the protective shield 30 can be configured to deflect emissions in a generally downwards direction away from the bezel and/or the control panel. In other examples, the protective shield 30 can also deflect the emissions in other directions, such as to the sides of the cooking apparatus 10 or other varying angular directions so as to deflect the emissions away from the control panel 16. An example of an angular direction is a direction that is partially downwards and partially to the sides of the cooking apparatus 10, to the front of the cooking apparatus 10, or to the rear of the cooking apparatus 10. The bezel 18 has a shape that can extend outwards beyond the control panel 16. This shape results in the protective shield 30 being configured to deflect the emissions towards the front of the cooking apparatus 10 and away from the bezel and/or the control panel. The protective shield 30 can have a shape, or a length 46 as seen in FIG. 3, that extends further outwards beyond the edge of the control panel 16 and can also extend beyond the edge of the bezel 18 to deflect emissions from the entire surface of the bezel 18. In other examples, the protective shield 30 can have various shapes or lengths 46. Increased lengths for the protective shield 30 can also provide improved deflections for the emissions from the exit 52.

In FIG. 3, a sectional side view of the channel 50 and the protective shield 30 is shown. The channel 50 can include a first sidewall 58 and a second sidewall 60. The emissions from the oven can be transported through the channel 50. The channel 50 can include a substantially vertical section for the emissions to rise towards the exit 52. In other examples, the first side wall 58 and the second sidewall 60 can be formed in different orientations. The exit 52 in this example can be placed in a location that results in the emissions making an approximate 90 degree turn from moving in a general vertical direction to moving in a general horizontal direction. It is appreciated that this is just one example of a path that a channel 50 can have as the channel 50 also can include one or more vertical, horizontal, curved, or angled sections. The exit 52 is located at an exterior portion of the housing structure 20 and the exit 52 can include an upper surface 54. In the example shown, the upper surface 54 of the exit 52 can extend at a downwards angle. In other examples, the upper surface 54 of the exit 52 can be generally horizontal or can extend at an upwards angle. The exit 52 can also include a lower surface 56. The upper surface 54 of the exit 52 can extend out further than the lower surface 56 of the exit 52, as seen in the shown example. As shown in this example, the lower surface 56 of the exit 52 can be generally horizontal. In other example, the lower surface 56 can extend at an upwards angle or at a downwards angle. In other examples, the lower surface 56 of the exit 52 can be an integral part of the vertical section 15 of the top surface 14. In other examples, the protective shield 30 can be coupled to the housing structure 20 such that the protective shield 30 is connected to one of the upper surface 54 of the exit 52 or a bottom edge of the bezel 18. For instance, the protective shield 30 can be connected to the upper surface 54 of the exit 52. In another example, the protective shield 30 can be connected to the bezel 18. The protective shield 30 can be connected to the bottom surface of the bezel 18 or can also be connected to the sides of the bezel 18 where the protective shield 30 extends downwardly to still cover the bottom surface of the bezel 18. The exit 52 in this example has a generally rectangular shape when viewed from a front view due to the orientation of the lower surface 56 of the exit 52, but it is appreciated that the exit 52 can be comprised of other shapes such as circular, oval, quadrilateral, etc.

The protective shield 30 in this example includes a first portion 34 and a second portion 36. The first portion 34 has a generally horizontal orientation when viewed from the side. The second portion 36 of the shield extends downwardly from the first portion 34 when viewed from the side. In another example, the second portion 36 of the shield can also have a curvature and can have an end that extends downwardly from the first portion 34. Thus, the end of the protective shield 30 can be located at a lower position than the remaining portions of the protective shield 30. Providing a lower position for the end of the protective shield 30 can result in an improved deflection of the emissions from the exit 52 in a direction away from the control panel 16 and the bezel 18. In other examples, the protective shield 30 can have a second portion 36 that has a curvature and the first portion 34 has either a generally horizontal orientation, a generally vertical orientation, or a curved, concave, or convex orientation in any angular direction. In one example, any of the portions of the protective shield 30 can have a curved portion. In other examples, the end of the protective shield 30 can be located at a vertical position that is substantially the same as the other portions of the protective shield 30. In other examples, the protective shield 30 can have a curvature where both the first portion 34 and the second portion 36 have a curvature when viewed from the side view. In other examples, the protective shield 30 can have a first portion 34 where a curvature extends downwardly from the point the protective shield 30 is coupled to either the bezel 18 or the exit 52. In this example where the first portion 34 has a curvature that extends downwardly, the protective shield 30 can have a second portion 36 that has either a generally horizontal orientation, a generally vertical orientation, or a curved, concave, or convex orientation in any angular direction. It is appreciated that the protective shield 30 can have one continuous section or can have a plurality of sections of various geometries.

The protective shield 30 can have a length 46 that extends outwards beyond the control panel 16. In the example shown, the protective shield 30 can have a length 46 that extends outwards beyond the control panel 16 and the bezel 18 to further deflect emissions. The various shapes for the protective shield 30 or for the first portion 34 and the second portion 36 can result in different directions to deflect emissions away from the bezel 18 and the control panel 16. For example, a generally downwards direction can be provided or the shield can deflect heat in a lateral direction, such as towards the left side or the right side of the cooking apparatus 10. The protective shield 30 can also deflect the emissions in other directions, such as various angular directions downwardly so as to deflect the emissions away from the control panel 16. Thus, many directions of deflection can be used for the protective shield 30 to deflect heat away from a desired location, such as away from the control panel 16.

Figure 4:
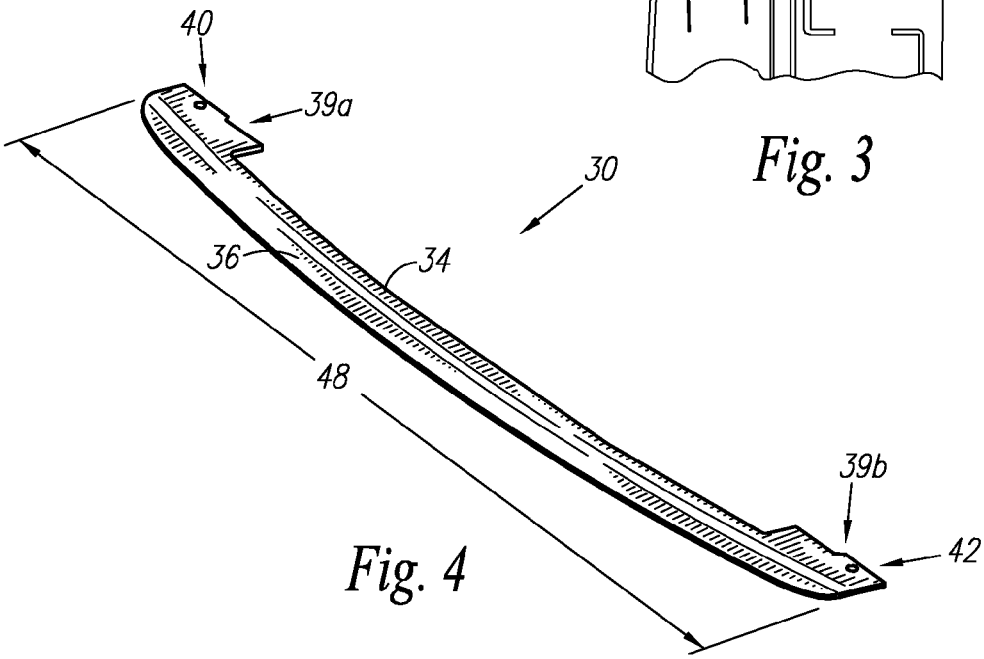
FIG. 4 is a perspective view of the example shield of FIG. 3.

FIG. 4 shows a perspective view of the protective shield 30. It is to be appreciated that as an alternative to the disclosed example, many different shapes for the protective shield 30 can be used. The protective shield 30 can have a width 48 that is relatively equal to the width of the cooking apparatus 10, such that the width 48 corresponds to the width of cooking apparatus 10. However, any suitable width for deflecting heat can be employed. For instance, the protective shield 30 can have a width that corresponds substantially to the dimension or the shape of the exit 52. The first portion 34 can have a curvature, a horizontal orientation, or a vertical orientation when viewed from the side. In the example shown, the first portion 34 can further include a connecting portion that is configured to couple the protective shield 30 to the housing structure 20. The connecting portion can include a first connecting portion 39A and a second connecting portion 39B. The first connecting portion 39A and the second connecting portion 39B can be located on opposite ends of the protective shield 30. In this example, the first connecting portion 39A includes a first hole 40 and the second connecting portion 39B includes a second hole 42 for coupling the protective shield 30 to the housing structure 20 by connecting the protective shield 30 with a fastener to either the bezel 18, the channel 50, or to the upper surface 54 of the exit 52. In other examples, the protective shield 30 can be connected to other structures while still being coupled to the housing structure 20. The screw holes 40, 42 are configured to engage a fastener to attach the protective shield 30 to the bezel 18, the channel 50, or the upper surface 54 of the exit 52. The upper surface 54 of the exit 52 can comprise the outer wall for the path of the heat emissions. Other ways to attach the protective shield 30 can be formed on the protective shield 30. The first connecting portion 39A and the second connecting portion 39B can have different dimensions than the other portions of the protective shield 30. In other examples, only one connecting portion is provided along various locations of the protective shield 30. In further examples, one connecting portion can extend along a substantial amount of the first portion 34 of the protective shield 30. In further examples, the connecting portion can include more than one hole for receiving a fastener. Providing a connecting portion 39A, 39B can allow the protective shield 30 to easily be assembled onto an existing cooking apparatus 10 or for that the shield to be installed on a new cooking apparatus 10. In still further examples, a connecting portion 39A, 39B or the first hole 40 and the second hole 42 can be connected to the second portion 36 of the protective shield 30. Moreover, providing a connecting portion is optional as other fasteners, adhesives, and/or other suitable methods and devices can be used to attach the protective shield 30 to the cooking appliance.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A cooking apparatus comprising:

a housing structure;

an internal heating source located within the housing structure;

an exit located at an exterior portion of the housing structure, wherein the exit is configured to transport heat emissions from the internal heating source;

a control panel located above the exit; and a protective shield coupled to the housing structure, wherein the protective shield is configured to deflect the heat emissions in a direction away from the control pane, and wherein the protective shield includes a first portion, the first portion has a generally horizontal orientation when viewed from the side, a second portion, wherein the second portion includes a curved portion, and a connecting portion to couple the protective shield to the housing structure, the connecting portion includes a first connecting portion extending from the first portion at a first distal end, and a second connecting portion extending from the first portion at a second distal end.

2. A cooking apparatus according to claim 1 wherein the protective shield has a length that extends outwards beyond the control panel.

3. A cooking apparatus according to claim 1 wherein the protective shield has a width that is relatively equal to the width of the cooking apparatus.

4. A cooking apparatus according to claim 1 wherein:

the protective shield includes a first portion and a second portion; and the second portion of the protective shield extending downward when viewed from the side.

5. A cooking apparatus according to claim 1 wherein:

the protective shield includes a first portion and a second portion; and the second portion of the protective shield extends downwardly from the first portion when viewed from the side.

6. A cooking apparatus according to claim 1 further comprising:

a bezel located above the exit wherein the bezel is located below the control panel;

wherein the control panel and the bezel are supported by the housing structure above the exit.

7. A cooking apparatus according to claim 6 wherein the protective shield has a length that extends outwards beyond the bezel.

8. A cooking apparatus according to claim 1 further comprising at least one heating element located on a top surface of the cooking apparatus.

9. A cooking apparatus according to claim 1 further comprising a channel located within the housing structure wherein the channel is configured to transport the heat emissions from the internal heating source to the exit.

10. A cooking apparatus comprising:

at least one heating element located on a top surface of the cooking apparatus;

a housing structure located below the at least one heating element;

an internal heating source located within the housing structure;

an exit located at an exterior portion of the housing structure, wherein the exit is configured to transport heat emissions from the internal heating source and wherein the exit includes an upper surface;

a channel located within the housing structure, wherein the channel is configured to transport the heat emissions to the exit;

a control panel supported by the housing structure above the exit;

a bezel located above the exit and supported by the housing structure, wherein the bezel is located below the control panel;

a protective shield connected to one of the upper surface of the exit or a bottom edge of the bezel;

wherein the protective shield has a length that extends outwards beyond the control panel;

wherein a first portion of the protective shield includes a first connecting portion and a second connecting portion that are configured to connect the protective shield to one of the upper surface of the exit or the bottom edge of the bezel;

wherein the first portion of the protective shield is generally horizontal when viewed from the side;

wherein a second portion of the protective shield has a curvature and extends downwardly from the first portion when viewed from the side;

wherein the first connection portion extends from the first portion at a first distal end, and the second connecting portion extends from the first portion at a second distal end; and wherein the protective shield is configured to deflect emissions in a direction away from the bezel and the control panel.

11. A cooking apparatus according to claim 10 wherein the protective shield has a width that is relatively equal to the width of the cooking apparatus.

12. A cooking apparatus according to claim 10, wherein the protective shield abuts the bezel.

13. A cooking apparatus according to claim 10, wherein the protective shield connects to the bezel at the first connecting portion and the second connecting portion.

* * * * *